United States Patent [19]

Csepke

[11] 4,206,993

[45] Jun. 10, 1980

[54] FILM-PRINT PROCESSOR

[76] Inventor: Neil A. Csepke, 3311 Ashton Pl. #152, Galveston, Tex. 77551

[21] Appl. No.: 24,797

[22] Filed: Mar. 28, 1979

[51] Int. Cl.[2] ..... G03D 3/08

[52] U.S. Cl. ..... 354/323; 354/324; 354/330

[58] Field of Search ..... 354/299, 323, 324, 326, 354/327, 328, 329, 330, 331; 366/219, 220

[56] References Cited

U.S. PATENT DOCUMENTS

| | | | |
|---|---|---|---|
| 3,000,288 | 9/1961 | Winnek | 354/299 |
| 3,623,416 | 11/1971 | Anderberg | 354/323 |
| 3,672,288 | 6/1972 | Deltoro | 354/323 |
| 3,792,487 | 2/1974 | Peres | 354/330 |
| 3,840,214 | 10/1974 | Merz | 354/330 |
| 3,890,629 | 6/1975 | Huss | 354/323 |
| 3,982,259 | 9/1976 | Baerle | 354/329 |
| 4,035,818 | 7/1977 | King | 354/331 |
| 4,054,902 | 10/1977 | Rebek | 354/323 |

*Primary Examiner*—L. T. Hix
*Assistant Examiner*—Alan Mathews
*Attorney, Agent, or Firm*—Clarence A. O'Brien; Harvey B. Jacobson

[57] ABSTRACT

A cabinet for support from a suitable support surface including upper tank portion and a lower open sump portion wherein the tank portion includes inlet and outlet structure opening into and outwardly therefrom for circulating a liquid at a predetermined temperature through the tank portion. A plurality of photographic solution containers are disposed within the tank for circulation of the liquid around the containers to maintain those solutions at the aforementioned predetermined temperature. Each container includes a valved gravity outlet disposed exteriorly of the tank and above the sump portion whereby photographic solutions which may drip from the valved outlets will fall into the sump portion. Further, the outlet structure for the tank comprises a standpipe which drains into the sump portion for flushing the latter free of photographic solutions with the aforementioned liquid, the sump including an outlet therefore. Also, the sump includes structure for supporting an elongated horizontal cylindrical developing drum therein for angular displacement about the longitudinal axis of the drum and motor structure is provided for driving the drum at a predetermined angular speed.

4 Claims, 6 Drawing Figures

FILM-PRINT PROCESSOR

BACKGROUND OF THE INVENTION

Persons who occasionally develop films and prints as well as persons who develop reasonable quantities of films and prints each day are constantly attempting to find ways to better develop films and prints and to accomplish the developing processes more rapidly and efficiently. Although various forms of film and print processors have been heretofore designed for other than production developing and which are usable by persons who wish to occasionally develop films and prints as well as persons who develop reasonable quantities of films and prints each day, these previously known processes are not constructed in a manner to facilitate ease of use, efficiency of the developing processes and with concern as to the problems of clean-up after developing operations have been completed. Accordingly, a need exists for a processor which will enable efficient film and print processing, enable film and print processing in the shortest possible time and substantially eliminate all conventional clean-up operations.

BRIEF DESCRIPTION OF THE INVENTION

The film-print processor of the instant invention comprises a cabinet including an upper tank portion in which a plurality of photographic solution containers are disposed and through which a liquid such as water at a predetermined temperature may be readily circulated for maintaining the photographic solutions within the containers at a predetermined temperature. The cabinet includes a lower sump portion disposed immediately beneath the tank portion and each of the containers includes a lower outlet opening downwardly through the bottom of the tank portion and into the upper sump portion and is provided with a valved gravity outlet. Further, the outlet for the tank is elevated within the interior of the tank in order that the outlet may define a maximum level of liquid therein and the outlet opens downwardly into the bottom of the sump portion of the cabinet for flushing the interior of the sump portion free of photographic solutions which may be poured or drip thereinto. Also, the lower sump portion of the cabinet includes structure for rotatably journaling a cylindrical developing drum and is also provided with motor structure for driving the drum at a predetermined angular speed.

The main object of this invention is to provide a film-print processor which may be utilized efficiently to develop films and prints.

Another object of this invention is to provide a processor constructed in a manner whereby a plurality of tanks of photographic solutions may be maintained at a predetermined temperature.

A further object of this invention is to provide a processor in accordance with the preceding objects and constructed in a manner whereby photographic solution which may spill or drop will be caught in a sump of the processor.

Yet another object of this invention is to provide a processor constructed in a manner whereby photographic solutions caught within the sump may be automatically flushed therefrom.

A further important object of this invention is to provide a film-print processor in whose sump a developing drum may be efficiently rotatably supported for angular displacement about a horizontal axis.

Yet another important object of this invention is to provide a processor including a motor drive by which the journaled drum may be driven at a predetermined angular speed.

A final object of this invention to be specifically enumerated herein is to provide a processor in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
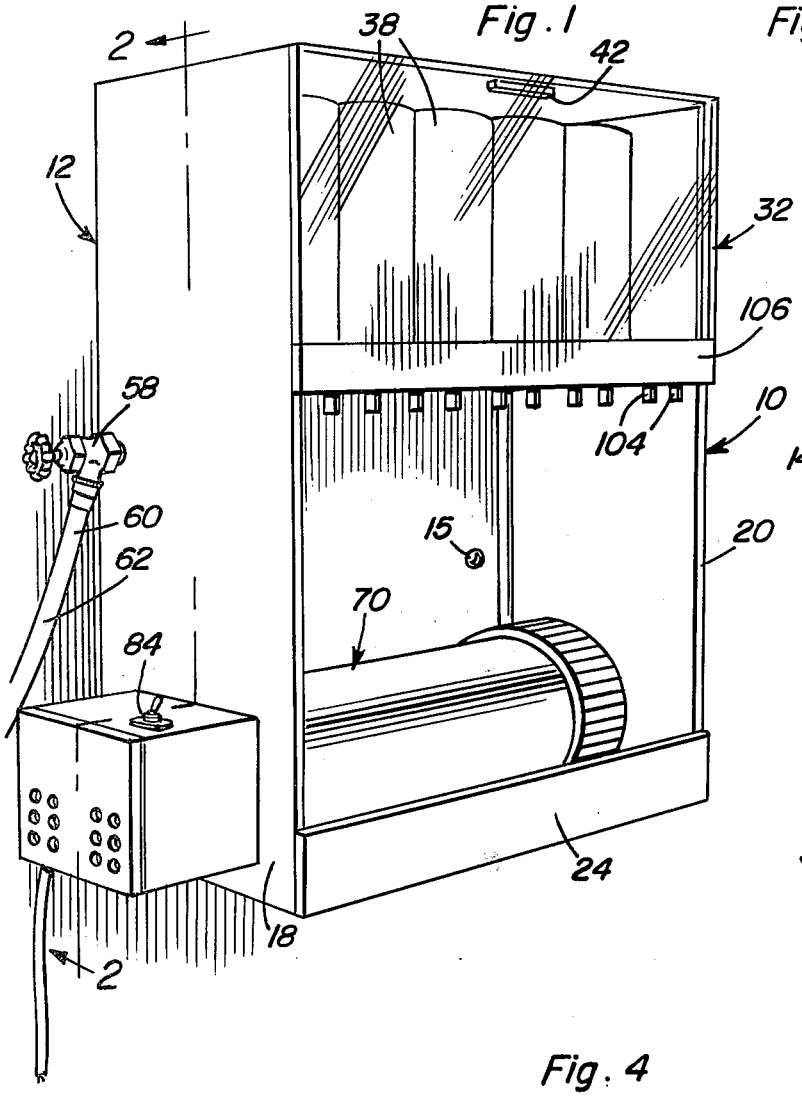
FIG. 1 is a perspective view of the film-print processor of the instant invention.
Figure 5:
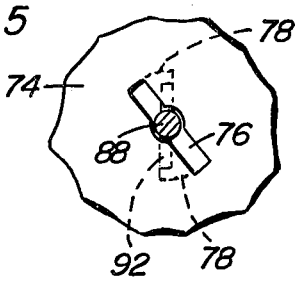
FIG. 5 is an enlarged fragmentary vertical sectional view taken substantially upon the plane indicated by the section line 5—5 of FIG. 2.
Figure 6:
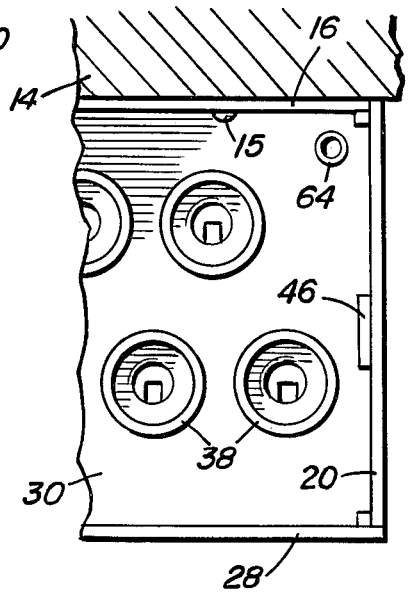
FIG. 6 is a fragmentary top plane view of the upper tank portion of the processor illustrating the liquid level overflow type drain therefor.
Figure 4:
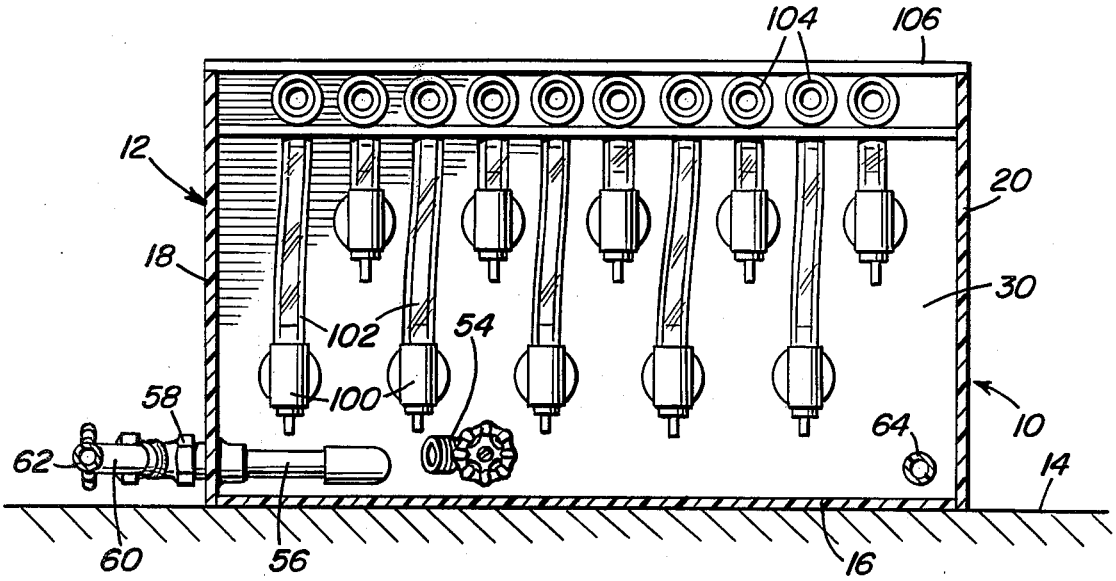
FIG. 4 is a horizontal sectional view taken substantially upon the plane indicated by the section line 4—4 of FIG. 2.
Figure 3:
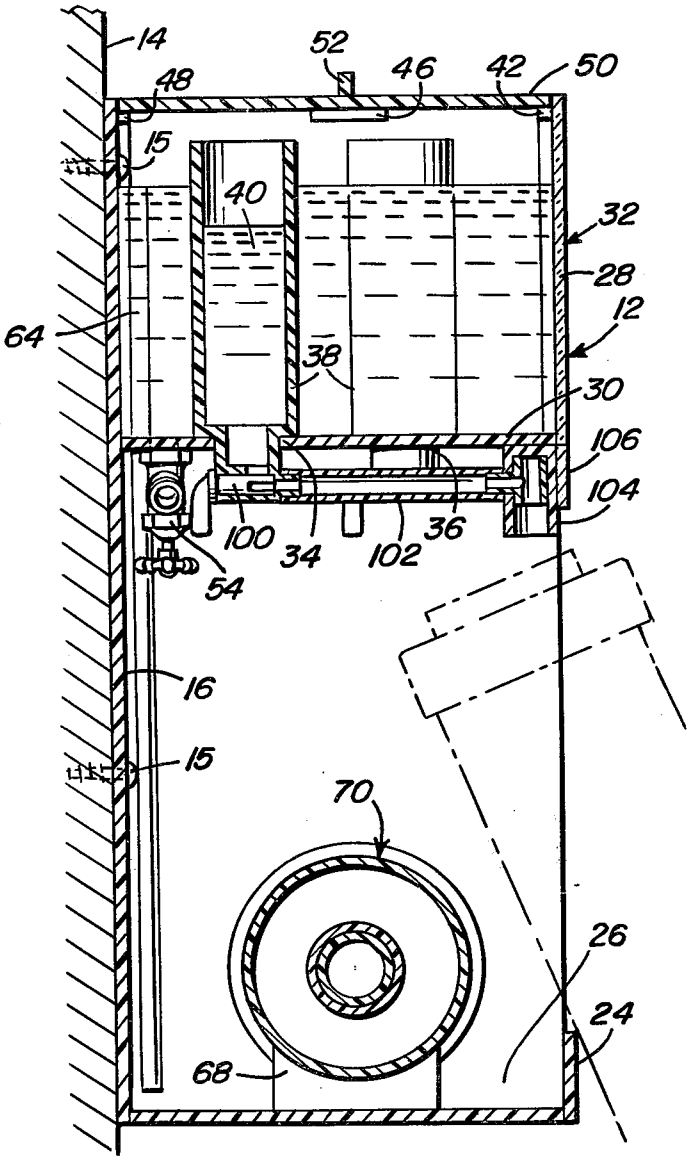
FIG. 3 is a vertical sectional view taken substantially upon the plane indicated by the section line 3—3 of FIG. 2.
Figure 2:
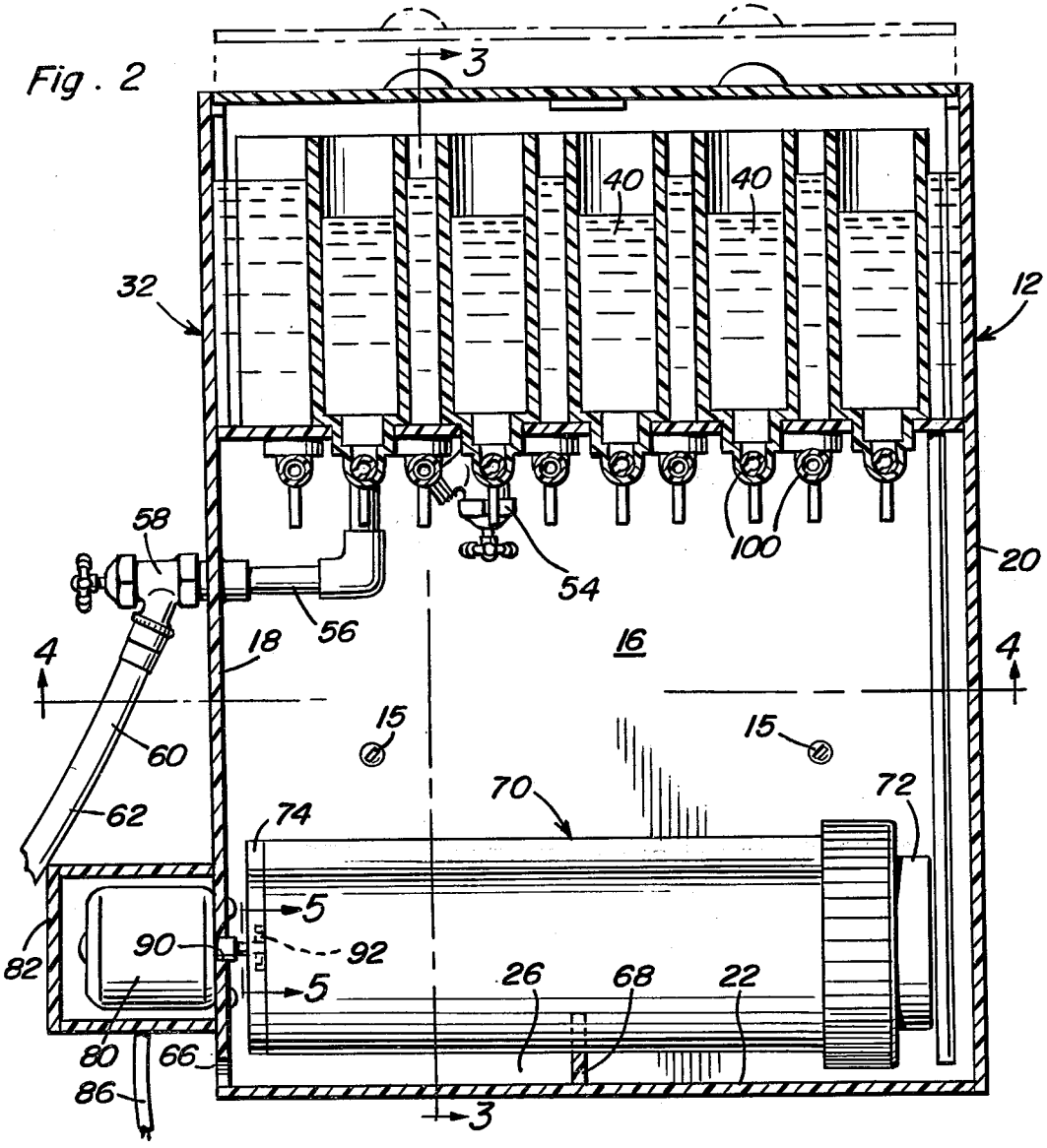
FIG. 2 is an enlarged vertical sectional view taken substantially upon the plane indicated by the section line 2—2 of FIG. 1.

Referring now more specifically to the drawings, the numeral 10 generally designates the film-print processor of the instant invention. The processor 10 is constructed in the form of an upright cabinet 12 for mounting upon a vertical wall surface 14 by screw-type fasteners 15. The cabinet 12 includes a rear wall 16, upstanding opposite side walls 18 and 20 and a bottom wall 22 interconnecting the walls 1, 18 and 20. Further, the cabinet also includes a lower partial front wall 24 closing the forward portion of a lower sump portion 26 defined within the cabinet 12 and the cabinet further includes a transparent partial upper front wall 28 extending between the upper marginal forward edge portion of the side walls 18 and 20 and an upper bottom wall 30 extending between the lower portion of the front wall 28 and the corresponding portions of the opposite side walls 18 and 20 and the rear wall 16. Thus, the cabinet 12 defines an upper tank portion referred to in general by the reference numeral 32 spaced above the sump portion 26.

The bottom wall 30 has a plurality of vertical openings 34 formed therethrough downwardly through which lower neck portions 36 of a plurality of upright containers 38 disposed within the tank portion 32 project. The neck portions 3 are sealed relative to those portions of the bottom wall 30 defining the openings 34 in any convenient manner and the upper ends of the containers 38 are open whereby various different photographic solutions 40 may be poured thereinto from above the upper ends of the containers 38.

The upper partial front wall 28 and the upper marginal edges of the opposite side walls 18 and 20 and rear wall 16 include abutments 42, 46 and 48 secured to the inner surfaces thereof and a removable top wall 50 is telescoped downwardly in the upper marginal portions of the walls 16, 18, 20 and 28 and rest upon the abutments 42, 46 and 48. The top wall 50 includes upwardly projecting flanges 52 which may be manually gripped and utilized to lift the top wall 50 from its position closing the upper portion of the tank portion 32.

The bottom wall 30 has a valved outlet fitting 54 secured upwardly therethrough which may be manually opened and closed as desired and an inlet pipe 56 includes a discharge end 58 which opens upwardly through the bottom wall 30 and is sealed relatively thereto. The inlet pipe 36 includes an inlet valve 58 which may be manually opened and closed and to which the outlet end 60 of a supply hose 62 is connected for supplying a liquid, such as water, at a predetermined temperature to the inlet pipe 56. Thus, the hose 62 may be utilized to convey a liquid at a predetermined temperature to the pipe 56 for discharging to the interior of the upper tank portion 32 for circulation about the containers 38 in order to maintain the photographic solution 40 within the container 38 at the temperature of the circulating liquid.

The rear right-hand portion of the interior of the upper tank portion 32 includes a standpipe 64 whose upper end is open and whose lower end opens downwardly through the bottom wall 30 and extends downwardly to a point spaced only slightly above the bottom wall 22. Thus, the liquid admitted into the upper tank portion 32 through the hose 62 and pipe 56 will rise to the level of the upper end of the standpipe 64 and then drain downwardly through the standpipe 64 as more liquid is admitted into the tank portion 32. In this manner, the liquid being circulated through the interior of the tank 32 about the containers 38 will maintain the photographic solutions 40 within the container 38 at the temperature of the circulating liquid.

The lower rear portion of the side wall 18 has a drain opening 66 formed therethrough and thus the liquid which is discharged downwardly into the sump portion 26 from the upper portion of the tank portion 32 may drain from the sump portion 26 through the opening 66. Also, the liquid may be drained from the interior of the upper tank portion 32 down to the bottom wall 30 thereof by opening the valved outlet 54.

The bottom wall 22 includes a cradle 68 supported therefrom in which the midportion of a cylindrical developing drum referred to in general by the reference numeral 70 may be cradled. The developing drum 70 includes a removable top 72 on one end and a drive disc 74 is secured to the other closed end of the drum 70. The drive disc 74 includes a slot 76 formed through its central portion and the side of the disc 74 which opposes the closed end of the drum 70 includes recesses 78 opening into the slots 76. A gear drive motor 80 is mounted on the exterior of the side wall 18 and enclosed within a ventilated housing 82 and the housing 82 has an on-off switch 84 mounted thrugh its upper wall and an extension cord 86 is provided and communicates the electric motor 80 with a suitable source of electrical potential through the on-off switch 84.

The motor 80 includes a rotatable output shaft 88 which projects through an opening 90 provided in the side wall 18 and the output shaft 88 includes a diametric pin 92 supported therefrom and receivable through the slot 76 and into the recesses 78. Thus, the motor 80 may be utilized to drive the drum 70 at a predetermined angular speed, the drum 70 being rotatably cradled from the cradle 68. Inasmuch as the diametric pin 82 passes through the slot 76 and into the recesses 78, the rotary output shaft 88 of the motor 80 serves as a support for the adjacent end of the drum 70.

Each of the necks 36 includes a petcock-type outlet valve 100 operatively associated therewith and each of the outlet valves 100 opens into the inlet end of a discharge line 102. The outlet ends of the discharge lines 102 open into downwardly opening discharge fittings 104 disposed immediately behind a forward skirt portion 106 secured between the forward marginal edge portions of the side walls 18 and 20 immediately below the bottom wall 30 and the lower marginal edge of the upper front wall 28. Accordingly, when it is desired to place a photographic solution within the drum 70 before the drum 70 is positioned on the cradle 68, the cap of the drum is removed and the drum is held beneath a predetermined outlet fitting 104 and the corresponding petcock-type valve 100 is opened in order that the desired amount of photographic solution may be drained from the associated container 38 and into the drum 70. Then, the petcock-type valve 100 is closed, the cap of the drum is replaced and the drum 70 may be cradled on cradle 68 and positioned in a manner such that the pin 92 is received through the slot 76 and into the recess 78. Thereafter, the gear drive motor 80 is actuated by operation of the switch 84 and the motor 80 will drive the drum 70 at a predetermined angular speed. Of course, after the drum has been rotated for a predetermined length of time, the switch 84 is again actuated to terminate operation of the motor 80 and the drum 70 may be removed from engagement with the output shaft 88 of the motor and the cradle 68. Then, the top of the drum 70 is removed and the used photographic solution therein may be drained therefrom by pouring the used photographic solution into the sump portion 26. Of course, the photographic solution poured into the sump portion 26 will drain therefrom through the opening 66 and any remaining portion of the photographic solution within sump 26 will be flushed therefrom by the overflow of the circulating liquid from the upper tank portion 32 being discharged downwardly into the sump portion 26 through the standpipe 64.

After the day's utilization of the processor 10 has been completed, the valve 58 may be closed in order to terminate circulation of the liquid through the tank 32 exteriorly of the containers 38. Then, the valved outlet 54 may be opened and all of the liquid within the tank portion 32 exteriorly of the containers 38 may be drained therefrom into the sump portion 26. Of course, this considerable amount of liquid being drained from the tank portion 32 will thoroughly flush the interior of the portion 26 free of all remaining photographic solutions.

The drum may comprise any suitable drum such as the Paterson System 4 Developing Tank, manufactured by Paterson Products Ltd., London, England.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A film-print processor including a tank, inlet and outlet means opening into and outwardly from said tank for circulating a liquid at a predetermined temperature through said tank, a plurality of containers in said tank for circulation of said liquid therearound and for containing photographic solutions maintained at said temperature by said circulating liquid, said containers each including a valved gravity outlet disposed exteriorly of said tank, means defining an upwardly opening sump spaced vertically below said outlets for catching solutions which may drip therefrom, said sump including support means therein for supporting an elongated horizontal cylindrical developing drum therefrom over said sump and for angular displacement about the longitudinal axis of said drum, drive means operative to drive said drum at a predetermined angular speed, said outlet means for said tank comprising a drain line defining an inlet end opening into an upper portion of said tank below the upper end of said containers and an outlet end opening downwardly into said sump, said drain line functioning to define an automatic liquid level within said tank, said tank including a lower selectively openable and closable drain outlet therefor opening outwardly of said tank downwardly into said sump, said sump including a low drain opening therefor through which liquids discharged into said sump are drained therefrom.

2. The combination of claim 1 wherein said support means comprises an upwardly opening cradle mounted in said sump generally midway between said opposite side walls.

3. The combination of claim 1 wherein said processor comprises a cabinet for mounting on a wall, the lower portion of said cabinet defining said sump and the upper portion of said cabinet defining said tank.

4. The combination of claim 3 wherein the said drive means includes an electric motor, said cabinet including opposite side walls defining remote extremities of said sump and between which said drum is adapted to extend when supported from said support means, said motor being supported from the exterior of one of said side walls and including a rotary output shaft projecting through said one side wall and including a non-circular end thereon for torque input connection to and releasable supportive engagement with the adjacent end of said drum.

* * * * *